United States Patent [19]

Baur et al.

[11] Patent Number: 4,997,587

[45] Date of Patent: Mar. 5, 1991

[54] WASHING AND CLEANING AGENTS CONTAINING β-ALANINE-N,N-DIACETIC ACID

[75] Inventors: Richard Baur, Mutterstadt; Charalampos Gousetis, Ludwigshafen; Wolfgang Trieselt, Ludwigshafen; Werner Bochnitschek, Ludwigshafen; Alfred Oftring, Bad Durkheim, all of Fed. Rep. of Germany

[73] Assignee: BASF Aktiengesellschaft, Ludwigshafen, Fed. Rep. of Germany

[21] Appl. No.: 394,935

[22] Filed: Aug. 17, 1989

[30] Foreign Application Priority Data

Sep. 2, 1988 [DE] Fed. Rep. of Germany ..... 3829847

[51] Int. Cl.[5] ..... C11D 3/33; C11D 3/39

[52] U.S. Cl. ..... 252/102; 252/99; 252/140; 252/174.25; 252/527; 252/546; 252/DIG. 11

[58] Field of Search ..... 252/527, 546, 140, 174.25, 252/131, 99, 102, DIG. 11

[56] References Cited

U.S. PATENT DOCUMENTS

| | | | |
|---|---|---|---|
| 2,371,623 | 3/1945 | Henderson | 260/398.5 |
| 4,265,777 | 5/1981 | Boyer | 252/113 |
| 4,404,128 | 9/1983 | Anderson | 252/546 |
| 4,440,663 | 3/1984 | Boyer | 252/174.11 |
| 4,690,771 | 9/1987 | Ouhadi | 252/102 |

FOREIGN PATENT DOCUMENTS

| | | |
|---|---|---|
| 0089136 | 9/1983 | European Pat. Off. . |
| 2138684 | 1/1973 | France . |

OTHER PUBLICATIONS

*Organic Sequestering Agents*, pp. 564–565, Stanley Chaberek et al., 1959.

*Primary Examiner*—Dennis Albrecht

*Attorney, Agent, or Firm*—Oblon, Spivak, McClelland, Maier & Neustadt

[57] ABSTRACT

Washing and cleaning agents for aqueous use contain from 2 to 25% by weight, based on the total weight of the agent, of β-alanine-N,N-diacetic acid or an alkali metal or ammonium salt thereof as water softener. The washing and cleaning agent is effective in preventing hardness deposits on textiles and fabrics.

7 Claims, No Drawings

WASHING AND CLEANING AGENTS CONTAINING β-ALANINE-N,N-DIACETIC ACID

The present invention relates to washing and cleaning agents for aqueous use containing from 2 to 25% by weight, based on the total weight of the agent, of β-alanine-N,N-diacetic acid or an alkali metal or an ammonium salt thereof as water softener.

Washing and cleaning agents for aqueous use are in general made up of a combination of various surfactants and other auxiliary substances.

The other auxiliary agents include first and foremost softeners, i.e. substances capable of binding the water hardness ions, in particular $Ca^{++}$ and $Mg^{++}$ cations.

The water softeners used hitherto were chiefly phosphates which, however, are becoming increasingly undesirable for environmental reasons.

Recent phosphate substitutes are nitrilotriacetic acid and salts thereof, but these compounds are likewise not wholly satisfactory since they are not sufficiently effective in preventing hardness deposits, for example on textile fabrics.

It is an object of the present invention to provide washing and cleaning agents for aqueous use which contain water softeners which are more effective than nitrilotriacetic acid.

We have found that this object is achieved by washing and cleaning agents for aqueous use which contain from 2 to 25% by weight, based on the total weight of the agents, of β-alanine-N,N-diacetic acid or an alkali metal or ammonium salt thereof as water softener.

β-Alanine-N,N-diacetic acid, like nitrilotriacetic acid, is biodegradable and is particularly advantageously preparable on a large scale by reaction of acrylic acid with iminodiacetic acid in an aqueous medium (see our German Pat. application P 38 29 859.7-O.Z. 0050/40154).

An additional advantage of β-alanine-N,N-diacetic acid is its (compared with nitrilotriacetic acid) lower binding power for heavy metal ions such as $Cu^{2+}$ or $Cd^{2+}$, as is shown by comparison of the corresponding equilibrium constants on pages 564 and 565 of Organic Sequestering Agents, A. E. Martell, J. Wiley & Sons, N.Y. (1959). This reduces the likelihood that heavy metal ion deposits in river sediments will be resuspended by traces of undegraded β-alanine-N,N-diacetic acid.

Based on the total weight of the washing and cleaning agents according to the invention, β-alanine-N,N-diacetic acid or its alkali metal or ammonium salts are used in amounts of from 2 to 25, preferably from 5 to 15%, by weight. It is particularly advantageous to sue its alkali metal salts, of which the trisodium salt is particularly preferred. However, it is also possible to use the salts of β-alanine-N,N-diacetic acid with basic compounds such as potassium hydroxide, ammonia or primary, secondary or tertiary aliphatic organic amines of from 1 to 4 carbon atoms in the aliphatic radicals such as methylamine, dimethylamine or trimethylamine.

The remaining constituents of the washing and cleaning agents according to the invention depend on the specific intended use.

Washing agents generally contain in addition from 5 to 50% by weight of other water softeners, from 6 to 25% by weight of surfactants as active detergents, from 5 to 35% by weight of bleaching agents, from 0 to 60% by weight of substances essentially for the consistency of the preparation and minor amounts of further assistants such as bleaching agent stabilizers, bleaching agent activators, enzymes, grayness inhibitors, foam regulators, corrosion inhibitors, fluorescent whitening agents, solubilizers, scents or dyes.

Cleaning agents contain in general as further essential ingredients from 30 to 80% by weight of soil-digesting components, from 3 to 20% by weight of other agents capable of binding hardness ions, from 2 to 10% by weight of surfactants, from 1 to 5% by weight of corrosion inhibitors, from 0 to α% by weight of substances essential for the consistency of the preparation and minor amounts of further assistants such as enzymes, foam regulators, scents, solubilizers or disinfectants.

The additional $Ca^{2+}$-and $Mg^{2+}$-binding assistants added to the washing and cleaning agents according to the invention can be alkaline substances such as sodium carbonate, sodium silicate and sodium phosphate or inorganic complexing agents, for example pyrophosphate, triuphosphate, higher polyphosphates and metaphosphates, or suitable organic complexing agents from the series of the alkane-polyphosphonic acids, amino- and hydroxy-alkanepolyphosphonic acid, phosphonocarboxylic acids, polycarboxylic acids, hydroxymono- or -polycarboxylic acids and aminocarboxylic acids, also, preferably for washing agents, ion exchange materials such as sodium aluminum silicates (zeolites), the complexing acids preferably being added in the form of their water-soluble salts.

Examples of suitable phosphorus-containing organic complexing agents are methanediphosphonic acid, propane-1,2,3-triphosphonic acid, butane-1,2,3,4-tetraphosphonic acid, polyvinylphosphonic acid, 1-aminoethane-1,1-diphosphonic acid, 1-amino-1-phenyl-1,1-diphosphonic acid, aminotrimethylenetriphosphonic acid, methylamino-or ethylamino-dimethylenediphosphonic acid, ethylene-diaminotetramethylenetetraphosphonic acid, 1-hydroxyethane-1,1-diphosphonic acid, phosphonoacetic acid, phosphonopropionic acid, 1-phosphonoethane-1,2-dicarboxylic acid, 2-phosphonopropane-2,3-dicarboxylic acid, 2-phosphonobutane-1,2,4-tricarboxylic acid, 2-phosphonobutane-2,3,4-tricarboxylic acid and the copolymers of vinylphosphonic acid and acrylic acid.

Examples of polycarboxylic acids are dicarboxylic acids of the general formula $HOOC—(CH_2)_n—COOH$ where n is from 0 to 8, also maleic acid, methylenemalonic acid, citraconic acid, mesaconic acid, itaconic acid, non cyclic polycarboxylic acids having 3 or more carboxyl groups in the molecule, e.g. tricarballylic acid, aconitic acid, ethylenetetracarboxylic acid, 1,1,3,3-propanetetracarboxylic acid, 1,1,3,3,5,5-pentanehexacarboxylic acids, e.g. cyclopentanetetracarboxylic acid, cyclohexanehexacarboxylic acid, tetrahydrofurantetracarboxylic acid, phthalic acid, terephthalic acid, benzenetri-, -tetra- or -pentacarboxylic acid, mellitic acid and polymeric polycarboxylic acids, e.g. the homopolymers of acrylic acid, hydroxyacrylic acid, maleic acid, itaconic acid, mesaconic acid, aconitic acid, methylenemalonic acid and citraconic acid, the copolymers of the abovementioned carboxylic acids with one another or with ethylenically unsaturated compounds such as ethylene, propylene, isobutylene, vinyl alcohol, vinyl mmethyl ether, furan, acrolein, vinyl acetate, acrylamide, acrylonitrile, methacrylic acid and crotonic acid, in which case co-polymers of acrylic acid (AA) and maleic acid (MA) in a weight ratio of 60:40 with a number average molecular weight ($\overline{M}_n$) of 70,000 being particularly preferred, and also the carboxymethyl ethers of sugars, of starch and of cellulose.

Suitable hydroxymono- or -polycarboxylic acids are glycolic acid, lactic acid, malic acid, tartronic acid, methyltartronic acid, gluconic acid, glyceric acid, citric acid, tartaric acid and salicylic acid.

Preferred aminocarboxylic acids are glycine, glycylglycine, alanine, asparagine, asparagine, glutamic acid, aminobenzoic acid, iminodiacetic acid, iminotriacetic acid, hydroxyethyliminodiacetic acid, ethylenediaminetetraacetic acid, hydroxyethylethylenediaminetriacetic acid, diethylenetriaminepentaacetic acid and higher homologs preparable by polymerization of an N-aziridylcarboxylic acid derivative, for example acetic acid, succinic acid or tricarballylic acid, and subsequent hydrolysis, or by condensation of polyamines having a molecular weight of from 500 to 10,000 with salts of chloroacetic or bromoacetic acid.

A suitable ion exchange ;material is in particular zeolite 4A, the preparation of which is described in Ullmanns Encyclopadie der technischen Chemie, 4th edition, volume 24, page 120.

Suitable surfactants are those which contain one or more hydrophobic organic radicals and water-solubilizing ionic or nonionic groups in the molecule. The hydrophobic radical is preferably an aliphatic hydrocarbon radical of from 8 to 26, preferably from 12 to 18, carbon atoms or an alkylaromatic radical having from 6 to 18, preferably from 8 to 16, carbon atoms in the alkyl group.

Particularly suitable anionic surfactants are the sodium, potassium and ammonium salts of carboxylic acids, sulfonic acids and sulfuric monoesters having the stated number of carbon atoms.

Of these, suitable surfactants of sulfonate type are in particular alkylbenzenesulfonates having from 9 to 15 carbon atoms in the alkyl radical, alkene- and hydroxyalkane-sulfonates and disulfonates as obtained for example from monoolefins having a terminal or internal double bond by sulfonation with gaseous sulfur trioxide and subsequent alkaline or acid hydrolysis. It is also possible to use alkanesulfonates obtainable from alkanes by chlorosulfonation or sulfoxidation and subsequent hydrolysis or neutralization or by bisulfite addition onto olefins. Further useful surfactants of the sulfonate type are the methyl and ethyl esters of $\alpha$-sulfo fatty acids.

Suitable surfactants of sulfate type are the abovementioned salts of sulfuric monoesters of primary and secondary alcohols. It is also possible to use sulfated fatty acid monoglycerides and sulfated reaction products of from 1 to 4 moles of ethylene oxide and primary or secondary fatty alcohols or alkylphenols.

Of the carboxylates, the sodium salts of natural fatty acids, i.e. ordinary soaps, are particularly suitable.

Preferred cationic surfactants are dialkyldimethylammonium chloride and imidazolinium salts of the type of 1-alkylamidoethyl-1-methyl-2-alkylimidazolinium methoxysulfate.

Suitable amphoteric surfactants, which in aqueous solution contain not only anionic but also cationic groups in the same molecule, are compounds of the type of the alkylbetaines or alkylsulfobetaines.

Nonionic surfactants are advantageously addition products of from 4 to 40, preferably from 4 to 20, moles of ethylene oxide on 1 mole of fatty alcohol, alkylphenols, fatty acid, fatty amine, fatty acid amide or alkanesulfonamide. Particular preference is given to the addition products of from 5 to 16 moles of ethylene oxide on primary or secondary alcohols of from 8 to 18, preferably from 12 to 18, carbon atoms and on mono- or dialkylphenols having from 6 to 14 carbon atoms in the alkyl radicals. However, besides these water-soluble nonionic surfactants it is also possible to use water-insoluble or sparingly water-soluble polyglycol ethers having from 1 to 4 ethylene glycol ether radicals in the molecule, in particular together with water-soluble nonionic or anionic surfactants.

Further suitable nonionic surfactants are the water-soluble addition products of ethylene oxide onto propylene glycol, alkylenediaminepolypropylene glycol and alkylpolypropylene glycols having from 1 to 10 carbon atoms in the alkyl chain which contain from 20 to 250 ethylene glycol ether groups and from 10 to 100 propylene glycol ether groups, where it is presumably the polypropylene glycol chain which acts as the hydrophobic radical.

Suitable bleaching agents are in particular peroxy compounds such as sodium perborate tetrahydrate ($NaBO_2 \times H_2O$), sodium perborate monohydrate ($NaBO_2 \times H_2O_2$), perborax ($Na_2B_4O_7 \times 4H_2O_2$) or peroxycarbonates such as $Na_2CO_3 \times 1.5H_2O_2$, but also inorganic or organic active chlorine compounds such as alkali metal hypochlorites or dichloro- and trichlorocyanuric acid.

In general, it is of advantage to incorporate together with the peroxy bleaching agent substances which stabilize the peroxy compounds. Water-soluble stabilizers are for example the organic complexing agents suitable for use as assistants for binding the hardness ions $Ca^{2+}$ and $Mg^{2+}$. Particular preference is given to using as water-insoluble stabilizers magnesium silicates $MgO:SiO_2$ of from 4:1 to 1:4, preferably from 2:1 to 1:2, in particular 1:1, in composition in amounts of from 0.5 to 4% by weight of the total preparation.

The activators used for the bleaching agents which provide $H_2O_2$ in water are preferably N-diacylated and N,N'-tetraacylated amines, for example N,N,N',N'-tetraacetylmethylenediamine or -ethylenediamine, N,N-diacetylaniline and N,N-diacetyl-p-toluidine, alkyl-N-sulfonylcarboxamidesj such as N-methyl-N-mesylacetamide, N-methyl-N-mesylbenzamide, N-methyl-N-mesyl-p-nitrobenzamide and N-methyl-N-mesyl-p-methoxybenzamide, N-acylated cyclic hydrazides, acylated triazoles or urazoles, for example monoacetylmaleohydrazide, O,N,N-trisubstituted hydroxylamines such as O-benzoyl-N,N-succinylhydroxylamine, O-acetyl-N,N-succinylhydroxylamine, O-p-methoxybenzoyl-N,N-succinylhydroxylamine, O-p-nitrobenzoyl-N,N-succinylhydroxylamine and O,N,N-triacetylhydroxylamine, N,N'-diacylsulfurylamides, for example N,N'-dimethyl-N,N'-diacetylsulfurylamide and N,N'-diethyl-N,N'-dipropionylsulfurylamide, triacyl cyanurates such as triacetyl or tribenzoyl cyanurate, carboxylic anhydrides such as benzoic anhydride, m-chlorobenzoic anhydride, phthalic anhydride and 4-chlorophthalic anhydride, sugar esters, for example glucose pentaacetate, 1,3-diacyl-4,5-diacyloxyimidazolidines such as 1,3-diformyl-4,5-diacetoxyimidazolidine, 1,3-diacetyl-4,5-diacetoxyimidazolidine and 1,3-diacetyl-b 4,5-dipropionyloxyimidazolidine, diacylated 2,5-diketopiperazines, for example 1,4-diacetyl-2,5-diketopiperazine, 1,4-dipropionyl-2,5-diketopiperazine and 1,4-dipropionyl-3,6dimethyl-2,5-diketopiperazine, the sodium salt of p-(ethoxycarbonyloxy) benzoic acid and of p-(propoxycarbonyloxy) benzenesulfonic acid, and the sodium salts of alkylated or acylated phenolsulfonic esters such as p-acetoxybenzenesulfonic acid, 2-acetoxy-5-nonylbenzenesulfonic acid, 2-acetoxy-5-propylbenzenesulfonic acid or of isononanoyloxyphenylsulfonic acid.

Grayness inhibitors are soil antiredeposition agents which keep the detached soil suspended in the aqueous solution. Suitable for this purpose are water-soluble colloids of an organic nature. Preference is given to the water-soluble salts of polymeric carboxylic acids, salts of ethercarboxylic acids or ethylsulfonic acids of starch or of cellulose, and to salts of acid sulfuric esters of cellulose or starch. It is also possible to use water-soluble polyamides which contain acid groups, and polyvinylpyrrolidone.

Possible enzymes for inclusion are proteases, carbohydrases, esterases, lipases, oxidoreductases, catalases, peroxidases, ureases, isomerases, lyases, transferases, desmolases and nucleases. Of particular interest are the enzymes, in particular proteases and amylases, obtained from bacterial strains or fungi such as Bacillus subtilis or Streptomyces griseus, which are relatively resistant to alkali, percompounds and anionic surfactants and are still active at up to 70° C.

Preference is given to using combinations of enzymes of various action, in particular combinations of proteases and amylases.

Textile-washing agents frequently and advantageously contain fluorescent whitening agents. For cotton it is preferred to sue derivatives of diaminostilbenedisulfonic acid or its alkali metal salts, for example the alkali metal salts of 4,4'-bis(2-anilino-4-morpholino-1,3,5-triazin-6-ylamino) stilbene-2,2'-disulfonic acid, for polyamide fibers 1,3-diaryl-2-pyrazolines, e.g. 1-(p-sulfamoylphenyl)-3-(p-chlorophenyl)-2-pyrazoline, and for polyester fibers 2,5-di(2-benzoxazolyl) thiophene or 1,2-di(5-methyl-2-benzoxazolyl) ethylene.

Alkaline washing agents generally include as corrosion inhibitors sodium silicates and potassium silicates having a silicon dioxide/alkali metal oxide ratio $\gtrsim 1$.

Suitable soil-digesting components for cleaning agents are in particular alkaline substances such as sodium hydroxide, potassium hydroxide, sodium carbonate, potassium carbonate, alkaline salts of orthophosphoric acid and sodium and potassium silicates having a silicon dioxide/alkali metal oxide ratio of from 0.7 to 1.5, and also organic and inorganic acids such as hydrochloric acid, phosphoric acid, phosphoric esters, sulfuric acid, oxalic acid, citric acid, formic acid, sulfamic acid, adipic acid, glutaric acid or succinic acid.

The washing and cleaning agents according to the invention can be pulverulent or liquid. To confer properties such as free flow, absence of clumping in varying atmospheric humidity and th elike on the pulverulent preparations, inorganic salts, in particular sodium sulfate, are added in general, while water is the basis of most liquid preparations.

Particular preference is given to washing agents which, based on the total preparation, contain from 10 to 30% by weight of zeolite and from 5 to 15% by weight of the trisodium salt of β-alanine-N,N-diacetic acid.

The washing and cleaning agents according to the invention can be prepared in a conventional manner; for example, the various constituents can be made up with water into an aqueous slurry which is then advantageously spray-dried in towers at 100° C.

INVENTION EXAMPLES I1 TO I5 AND COMPARATIVE EXAMPLES C1 TO C5

Determination of hardness deposits formed using various washing agents

To this end, 20 g pieces of cotton terytowelling were repeatedly washed and rinsed as test fabrics under the following experimental conditions:

| | |
|---|---|
| Washing machine | Launder-O-meter from Atlas, Chicago |
| No. of washing cycles | 20 |
| Amount of water per cycle | 125 ml for washing<br>125 ml for rinsing |
| Total hardness of water | 4 mmol ($Ca^{2+}$, $Mg^{2+}$) |
| Washing time per cycle | 30 min |
| Washing temperature | 60° C. |
| Washing agent dose | 8 g/l |

The washing agents used in Invention Examples I1 to I5 contained the trisodium salt of β-alanine-N,N-diacetic acid (ADA) to be used according to the invention, while in Comparative Examples C1 to C5 the ADA was replaced by the trisodium salt of nitrilotriacetic acid (NTA) representing the state of the art. In all cases, the washing agent was produced from an aqueous slurry of its individual constituents by spray-drying in towers at 100° C. A measure of the hardness deposits formed in the course of washing is the weight proportion of ash left behind on ashing the washed test fabric.

The composition of the washing agents used and the weight proportions of ash obtained are given in Table 1. Table 1 additionally contains the exact ionic composition of the total hardness of the water used, which was varied as an additional factor.

TABLE 1

| Washing conditions<br>Composition of washing agents<br>(% by weight) | Examples | | | | | | | | | |
|---|---|---|---|---|---|---|---|---|---|---|
| | I1 | C1 | I2 | C2 | I3 | C3 | I4 | C4 | I5 | C5 |
| Zeolite 4A | 22.7 | 22.7 | 21.9 | 21.9 | 23.8 | 23.8 | 23.5 | 23.5 | — | — |
| ADA | 9 | — | 12.3 | — | 5 | — | 6 | — | 9 | — |
| NTA | — | 9 | — | 12.3 | — | 5 | — | 6 | — | 9 |
| Sodium carbonate | 10.9 | 10.9 | 10.5 | 10.5 | — | — | — | — | 18.2 | 18.2 |
| Sodium citrate | — | — | — | — | — | — | — | — | 9.1 | 9.1 |
| Na salt of copolymer of 60% by wt. of AA and 40% by wt. of MA, Mn = 70,000 | — | — | — | — | 1.9 | 1.9 | 1.89 | 1.89 | — | — |
| Carboxymethylcellulose | 0.55 | 0.55 | 0.52 | 0.52 | 0.57 | 0.57 | 0.57 | 0.57 | 0.55 | 0.55 |
| n-Dodecylbenzene- | 5.7 | 5.7 | 5.5 | 5.5 | 5.95 | 5.95 | 5.9 | 5.9 | 5.68 | 5.68 |

TABLE 1-continued

| Washing conditions Composition of washing agents (% by weight) | Examples | | | | | | | | | |
|---|---|---|---|---|---|---|---|---|---|---|
| | I1 | C1 | I2 | C2 | I3 | C3 | I4 | C4 | I5 | C5 |
| sulfonate | | | | | | | | | | |
| Mixture of Na salts of $C_{16}$–$C_{18}$ fatty acids | 2.5 | 2.5 | 2.5 | 2.5 | 2.67 | 2.67 | 2.71 | 2.71 | 2.55 | 2.55 |
| Mixture of ethoxy lated $C_{13}$- and $C_{14}$ fatty alcohols (EO degree: 7) | 4.3 | 4.3 | 4.1 | 4.1 | 4.45 | 4.45 | 4.43 | 4.43 | 4.3 | 4.3 |
| Sodium perborate tetrahydrate | 18.2 | 18.2 | 17.5 | 17.5 | 19 | 19 | 18.9 | 18.9 | 18.2 | 18.2 |
| Magnesium silicate (1:1) | 0.9 | 0.9 | 0.88 | 0.88 | 0.95 | 0.95 | 0.94 | 0.94 | 0.9 | 0.9 |
| Sodium disilicate | 5.45 | 5.45 | 5.30 | 5.30 | 5.71 | 5.71 | 5.66 | 5.66 | 5.52 | 5.52 |
| Sodium sulfate | 19.8 | 19.8 | 19.0 | 19.0 | 30 | 30 | 29.5 | 29.5 | 26 | 26 |
| Composition of total hardness of 4 mmol/l $Ca^{2+}$:$Mg^{2+}$ | 4:1 | 4:1 | 1:2 | 1:2 | 4:1 | 4:1 | 1:2 | 1:2 | 1:2 | 1:2 |
| Ash (% by wt. of test fabric) | 0.85 | 1.98 | 1.09 | 2.08 | 0.68 | 1.02 | 1.12 | 2.02 | 1.04 | 2.28 |

We claim:

1. A fabric or textile washing or cleaning agent for aqueous use, comprising:

from 2 to 25% by weight, based on the total weight of the agent, of β-alanine-N,N-diacetic acid or an alkali metal or ammonium salt thereof as a water softener component;

from 5 to 50% by weight of other water softeners;

from 6 to 25% by weight of surfactants as active detergents;

from 5 to 35% by weight of bleaching agents; ;and from 0 to 60% by weight of substances which effect the consistency of the washing agent.

2. The washing or cleaning agent of claim 1, wherein the β-alanine-N,N-diacetic acid compound is the trisodium salt of the compound.

3. The washing or cleaning agent of claim 1, wherein the agent contains from 5 to 15% by weight of the trisodium salt of β-alanine-N,N-diacetic acid and 10 to 30% by weight of a zeolite.

4. The washing or cleaning agent of claim 1, wherein said surfactant is an anionic, cationic, nonionic or amphoteric surfactant.

5. The washing or cleaning agent of claim 4, wherein said anionic surfactant is a carboxylate, sulfonate or sulfate salt.

6. The washing or cleaning agent of claim 4, wherein said nonionic surfactant is an addition product of from 4 to 40 moles of ethylene oxide with one mole of a fatty alcohol, an alkylphenol, a fatty acid, a fatty amine, a fatty acid amide

7. The washing or cleaning agent of claim 1, wherein said additional agent capable of binding hardness ions is sodium additional agent capable of binding hardness ions is sodium carbonate, sodium silicate, sodium phosphate an inorganic complexing agent, an organic complexing agent or an ion exchange material.

* * * * *